United States Patent [19]

Loose et al.

[11] 4,277,124

[45] Jul. 7, 1981

[54] CONNECTOR HAVING WIRE-IN-SLOT CONNECTING MEANS AND CRIMPED STRAIN RELIEF

[75] Inventors: Winfield W. Loose, Linglestown; Alan R. MacDougall, Harrisburg, both of Pa.

[73] Assignee: AMP Incorporated, Harrisburg, Pa.

[21] Appl. No.: 80,850

[22] Filed: Oct. 1, 1979

[51] Int. Cl.[3] ..... H01R 4/24

[52] U.S. Cl. ..... 339/99 R; 339/223 R

[58] Field of Search ..... 339/97 R, 97 C, 97 P, 339/98, 99, 103 R, 103 M, 223, 276 T

[56] References Cited

U.S. PATENT DOCUMENTS

| | | | |
|---|---|---|---|
| 2,701,350 | 2/1955 | Soreng | 339/276 T |
| 3,546,663 | 12/1970 | Holmberg, Jr. | 339/223 R |
| 3,894,783 | 7/1975 | Messner | 339/97 R |
| 3,909,935 | 10/1975 | Aldridge et al. | 29/628 |
| 4,159,156 | 6/1979 | Nijman | 339/97 C |

*Primary Examiner*—John McQuade

*Attorney, Agent, or Firm*—Frederick W. Raring

[57] ABSTRACT

Multi-contact electrical connector comprises a housing having a plurality of side-by-side cavities extending therethrough. Each cavity has a terminal therein which has a wire-in-slot connecting means intermediate its ends and a crimpable portion, adjacent to the rearward end of the cavity, which can be crimped onto a wire. The wire-receiving means and the crimpable means are arranged such that a wire can be inserted into the wire-receiving slot and the crimpable portion can be crimped onto the wire in a single stroke of an inserting and crimping tool.

7 Claims, 15 Drawing Figures

CONNECTOR HAVING WIRE-IN-SLOT CONNECTING MEANS AND CRIMPED STRAIN RELIEF

FIELD OF THE INVENTION

This invention relates to electrical connections of the type in which a wire is connected to a terminal by inserting the wire into a slot in the terminal. The invention further relates to the provision of a crimped strain relief means for the wire on the terminal.

BACKGROUND OF THE INVENTION

It is now common practice in the electrical industry to connect wires to terminals by providing a wire-receiving slot in the terminal, which slot is dimensioned such that when the wire is moved laterally of its axis into the slot, the edges of the slot will penetrate the insulation of the wire and establish contact with the conducting core thereof. It is also common practice to design multi-contact electrical connectors having terminals therein which have wire-receiving slots. A plurality of wires can be electrically connected to a like plurality of terminals in a connector by means of insertion tools which simultaneously insert the plurality of wires into the terminals. Terminals and connectors of these types permit the achievement of substantial cost reductions in the manufacture of electrical harnesses and cables having connectors on their ends and are coming into widespread use for this reason.

It is desirable to provide a strain relief of some sort between a wire and terminal to which the wire is connected so that when a tensile pull is applied to the wire, the load will be transmitted through the strain relief device to the terminal rather than through the electrical connection of the terminal to the wire. A strain relief thus functions as a stress bypass for tensile stresses applied to the wire and protects the electrical connection against damage.

Terminals and multi-contact electrical connectors having wire-in-slot connecting means for connecting the wire to the terminal, have in the past, been provided with several different types of strain relief devices and while these known strain relief devices are adequate under many circumstances, there is a need for an improved strain relief in connectors and terminals of the wire-in-slot type. For example, it is common to provide a terminal having two plate-like sections, each of which has a wire-receiving slot therein. One of these slots each serves to establish electrical contact with the wire and the other slot is dimensioned such that it serves as a strain relief. It is also common practice to provide a strain relief on the housing of a connector containing wire-in-slot type terminals so that tensile forces applied to the wire are transmitted to the connector housing rather than to the electrical connection between the wire and the terminal.

The present invention is directed to the achievement of an improved strain relief which will surpass the performance of previously known strain relief devices on wire-in-slot connecting devices, which does not require strain relief means on the insulating housing containing the terminals, and which can, in general, be used under virtually any circumstances where wire-in-slot type terminals are used.

A preferred embodiment of the present invention comprises an insulating housing having a plurality of side-by-side cavities therein, each of which contains an electrical contact terminal. Each terminal has a wire-receiving portion intermediate its ends and has a crimped portion proximate to the rearward end of the housing. The crimped portion comprises spaced-apart ears which extend from a web and which are offset with respect to each other. The sidewalls of the cavities are cut away in the vicinity of the upper end of each ear so that the ears can be engaged by a crimping tool and bent downwardly towards the web until they are in embracing relationship with the wire. The crimpable portion of each terminal is, moreover, located with reference to the wire-receiving portion, such that a wire can be inserted into a terminal and the crimpable portion can be crimped onto the wire during the single downward stroke of a crimping and inserting tool. Advantageously, all of the wires which are to be connected to the terminals in a connector are inserted into the terminals and the terminals are crimped onto the wires in a one-step insertion and crimping process.

PRACTICE OF THE INVENTION

Figure 1:
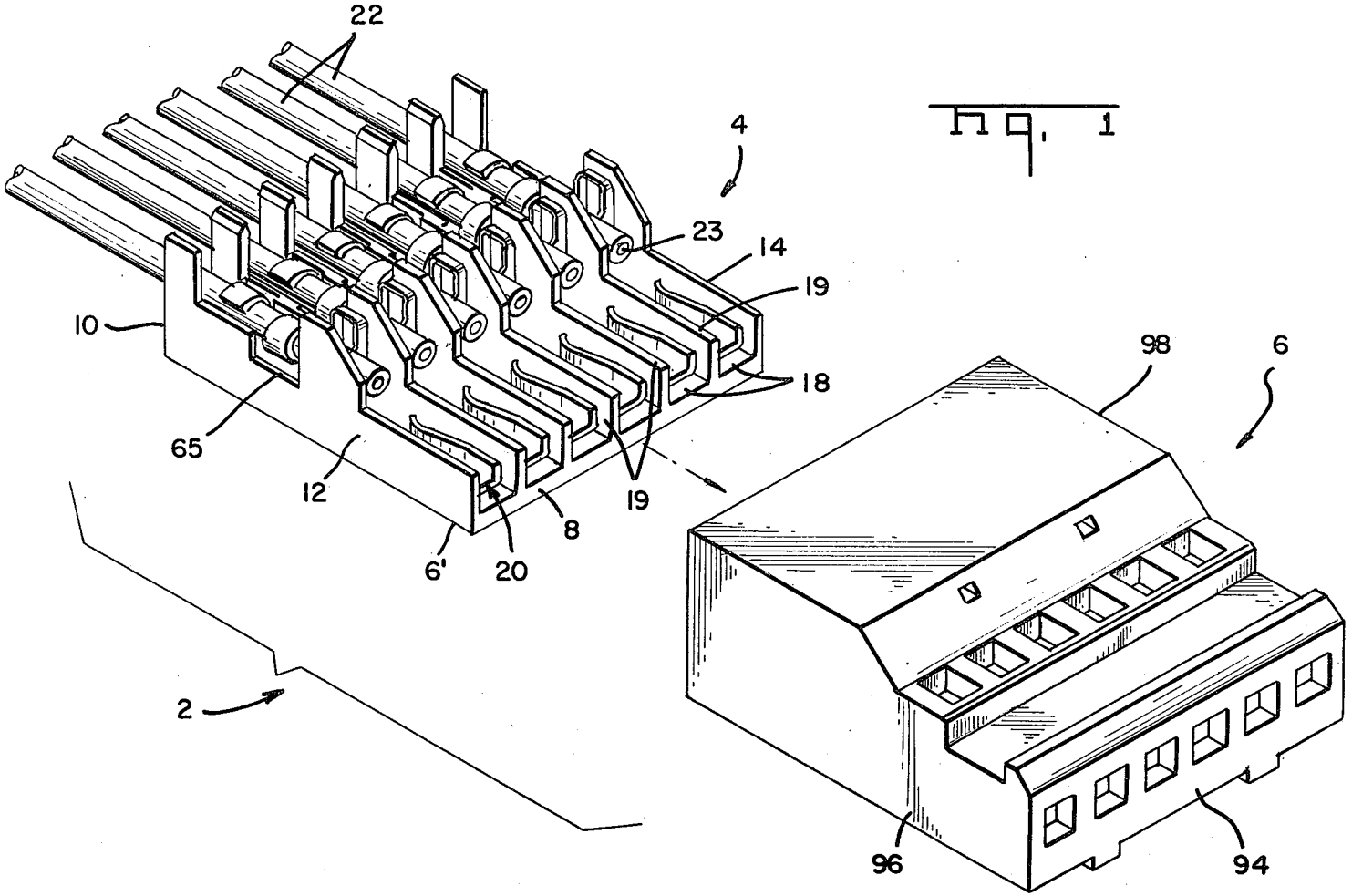
FIG. 1 is a perspective view of a multi-contact electrical connector in accordance with the invention, showing wires extending to each of the terminals and showing a shroud member exploded from the connector housing.

As shown in FIG. 1, connector assembly 2, in accordance with the invention, comprises an insulating housing 4 of suitable thermoplastic material, such as nylon, and an insulating shroud 6 which is dimensioned to fit over the housing after the wires have been connected to the terminals 20 in the housing.

The housing has a mating face 8, a wire entry face 10, oppositely directed endwalls 12, a first side 14 and a second side 16, the endwalls 12 and the sides 14, 16 extending between the faces as shown. A plurality of side-by-side cavities 18, which are separated by barrier walls 19, extend inwardly on the side 14 and a terminal 20 is disposed in each cavity. In the finished assembly, as installed on wires, the wires are connected to the terminals by a crimped connection described below, and the cores 23 of the wires are electrically connected to the terminals by a wire-in-slot connection.

The terminals 20 are of stamped and formed conductive material, such as brass, and each terminal has a contact portion 24 at its forward end, a wire-receiving portion 26 intermediate its end, and a crimpable strain relief portion 28 at its rearward end. The contact portion is, in the embodiment shown, in the form of a receptacle which is dimensioned to receive a contact post or pin. This contact portion thus has a flat web 30 from which flanges or beams 32 extend at the forward end of the contact portion. The beams extend rearwardly and are inclined towards each other so that the contact pin can be moved relatively between their opposed surfaces and the post will be contacted by the surfaces of the beams.

The contact portion is connected to the intermediate wire-receiving portion 26 by a flat connecting neck 34 from the side edges from which upwardly inclined flanges 36 extend. These flanges, and similar flanges 47, extending from a neck portion 46, serve as a retention means for retaining the individual contacts in their respective cavities, as will be described below.

The wire-receiving portion 26 comprises spaced apart plate-like members 38, 40 which are connected to each other at their upper free ends by spaced-apart connecting straps 42. Each plate-like member 38, 40 has a downwardly extending wire-receiving slot 44 therein, the width of at least one of these slots being less than the diameter of the conducting cores 23 of the wires 22 so that the edges of the slots will penetrate the insulation of a wire and establish contact with the core.

The crimpable strain relief portion 28 comprises a web 50 which is connected by a downwardly extending section 48 to the connecting neck 46 which extends from plate section 48. The web 50 is located below the upper free end of the wire-receiving portion 26 and above the connecting neck sections 34, 46 in order to permit crimping of the strain relief section onto a wire, as will be explained below.

Figure 2:
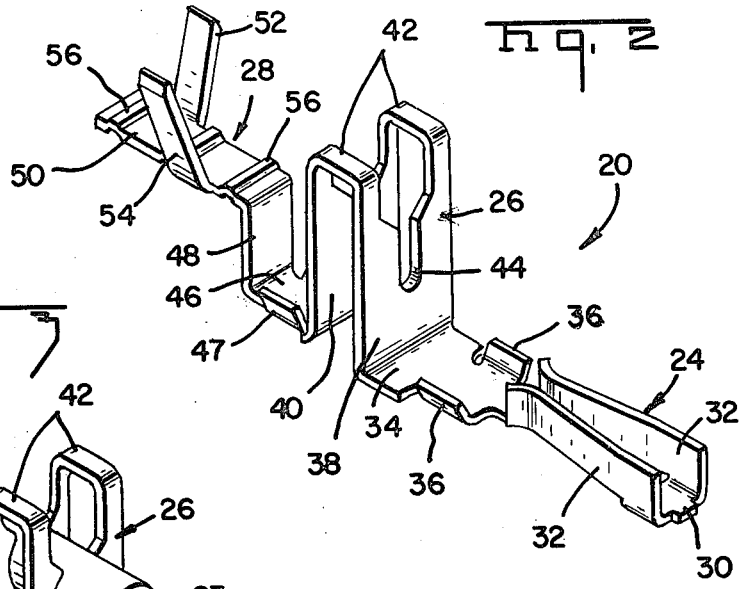
FIG. 2 is a perspective view of a terminal, in accordance with the invention, in its uncrimped condition.
Figure 3:
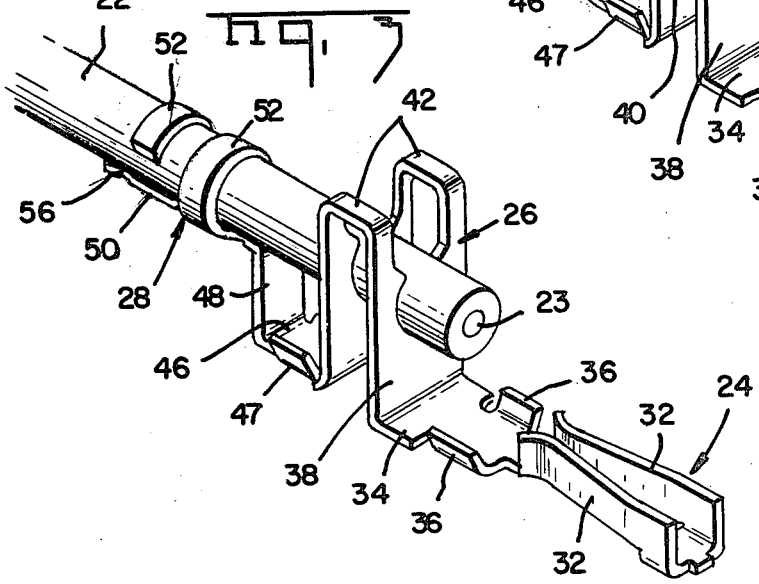
FIG. 3 is a perspective view showing the terminal and wire with the wire inserted into the wire-receiving portion of the terminal and with the terminal crimped onto the wire.
Figure 4:
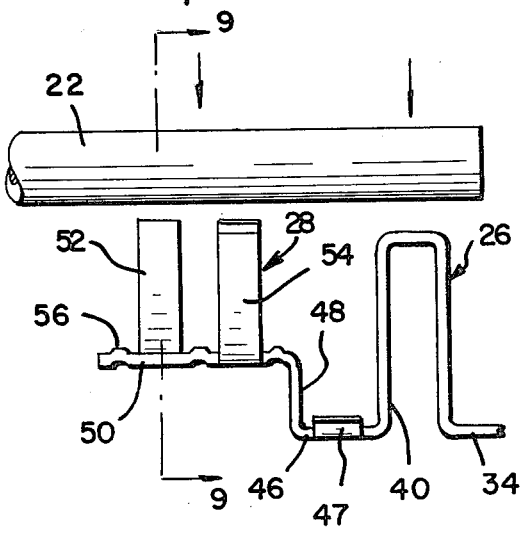
FIG. 4 is a side view of the terminal showing the wire in alignment with the wire-receiving portion and the crimp portion of the terminal.
Figure 5:
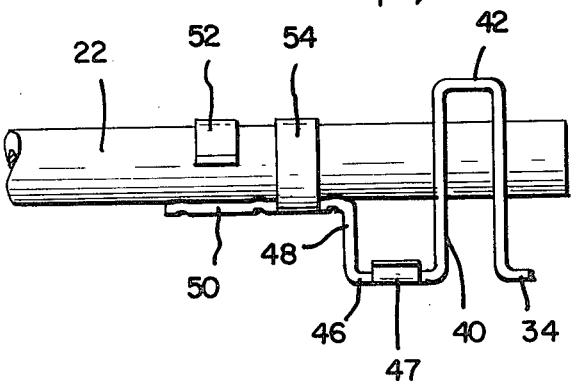
FIG. 5 is a view similar to FIG. 4 showing the wire inserted and the terminal crimped onto the wire.

First and second sidewall arms or ears 52, 54 extend from the side edges of the web 50, the first arm 52 being proximate to the rearward end of the web 50 while the second arm 54 is spaced from the rearward end. In the embodiment shown, corrugations or ribs 56 are provided on the web 50 to enhance the tightness of the crimped connection when the ears are crimped onto the wire 22, as shown in FIG. 2.

Figure 7:
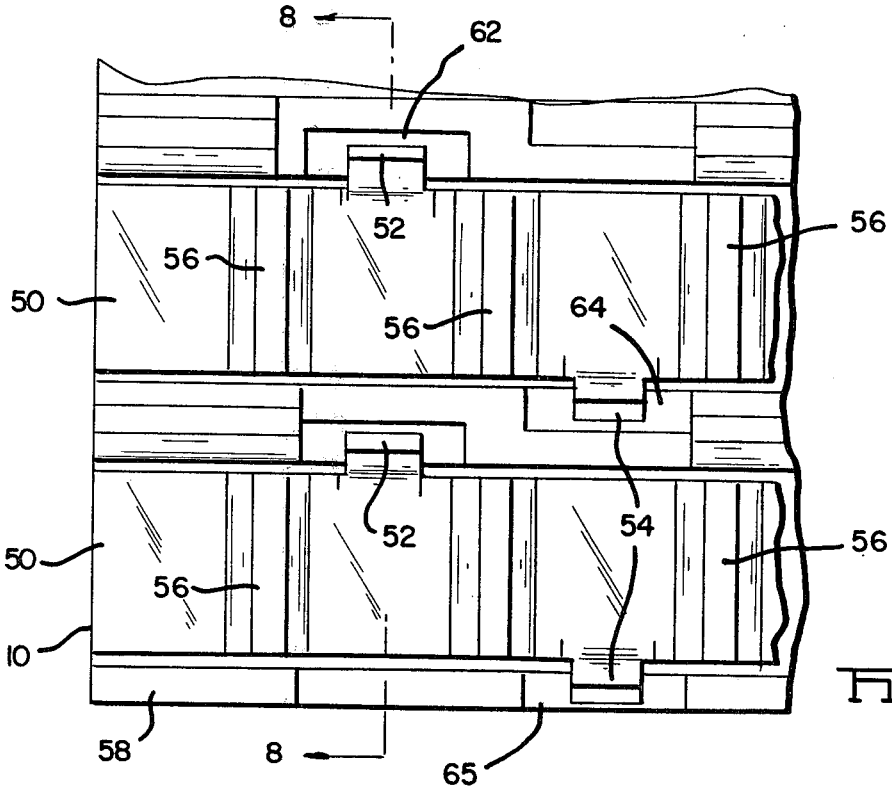
FIG. 7 is a fragmentary plan view, looking in the direction of the arrows 7—7 of FIG. 13, of a portion of the housing showing particularly the strain relief portions of the terminals prior to crimping.
Figure 15:
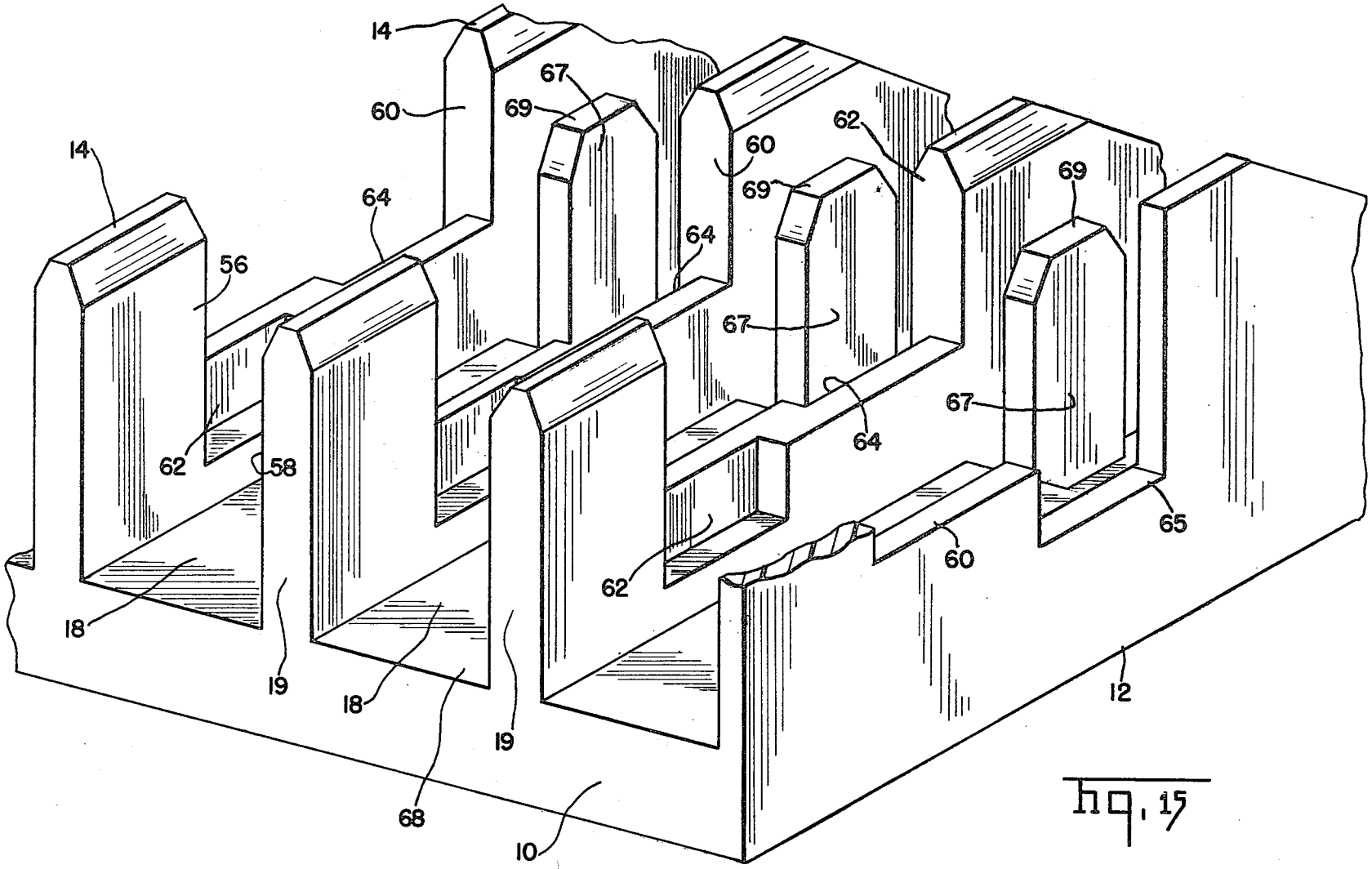
FIG. 15 is a fragmentary perspective view of the rearward portion of the connector housing.

The terminal-receiving cavities 18 extend inwardly from the first side 14 of the housing and each cavity has opposed cavity sidewalls 56, 58 which extend to the floors 66, 68 of the cavities. The barrier walls 19 which separate adjacent cavities 18 have rectangular notches 60 therein which extend inwardly from the outer edges of these barrier walls. Each sidewall 56 has a pocket or recess 62 therein extending partially towards the floor 68 of the cavity from the lower end of the notch, the recess 62 being proximate to the rearward or wire entry end of the housing. Each sidewall 58 has a similar recess or pocket 64 therein, extending downwardly from the lower end of the associated notch 60, the recesses 64 being relatively remote or spaced from the wire entry end. The notches 60 permit movement of the crimping dies downwardly past the side 14 of the housing, that is, past the upper ends of the barriers 19 between adjacent cavities, thereby to permit crimping of the arms 52, 54 onto the wires as will become apparent from the description of the crimping process presented below. The recesses 62, 64 provide clearance for the lower end portions of the arms 52, 54 as best shown or illustrated in FIG. 7. It will be noted that the endwall 12, shown in FIG. 15, has a notch portion 65 which extends below the notch 60 rather than a pocket 64. The endwall 12 has thickness which is substantially half the thickness of the individual barrier walls 19, in order to permit stacking of connector housings against each other while maintaining the spacing between adjacent terminals from one housing to the next. Because of the reduced thickness of the endwalls, notches, as shown at 65, are provided rather than recesses or pockets as shown at 64.

The sidewalls 56, 58 are provided with rectangular bosses 67 spaced forwardly from the notches 60. These bosses have shoulders 69 at their upper ends which support the connecting straps 42 of the terminals during insertion of the wires into the wire-receiving slots 44 in the plate-like sections 38, 40. As explained in Application Ser. No. 062,207, it is desirable to support the strap portions 42 during insertion of the wires because of the relatively high stresses imposed on the terminals during the wire insertion operation. In the absence of such shoulders, the wire receiving portions of the terminals could be damaged during wire insertion.

Figure 13:
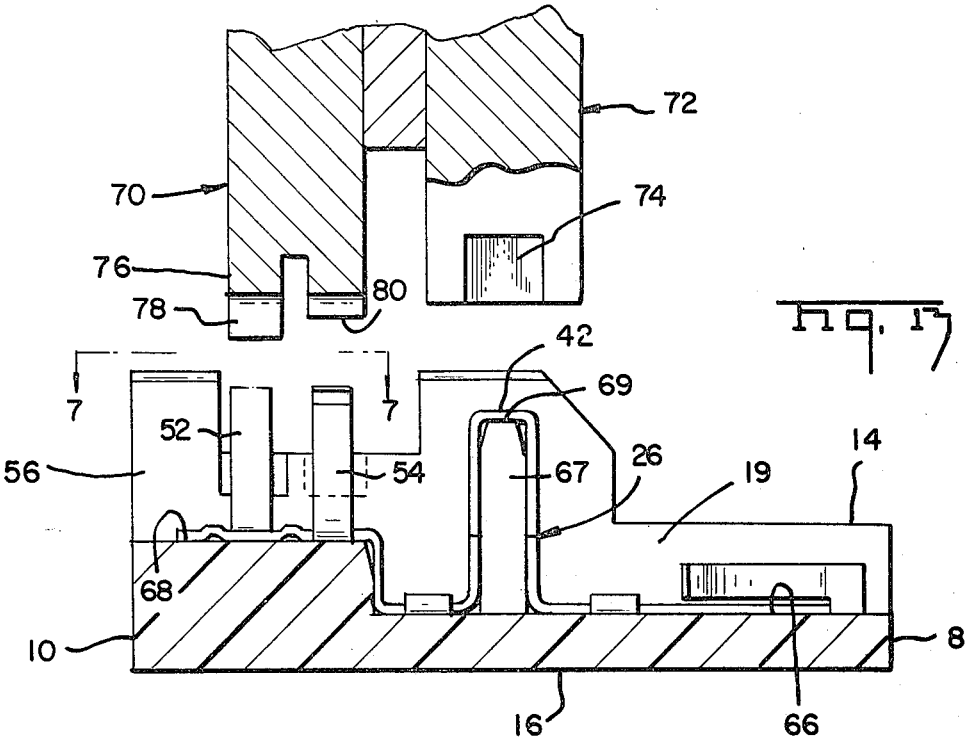
FIG. 13 is a sectional side view showing portions of a housing and showing the insertion and crimping tool above the housing.
Figure 14:
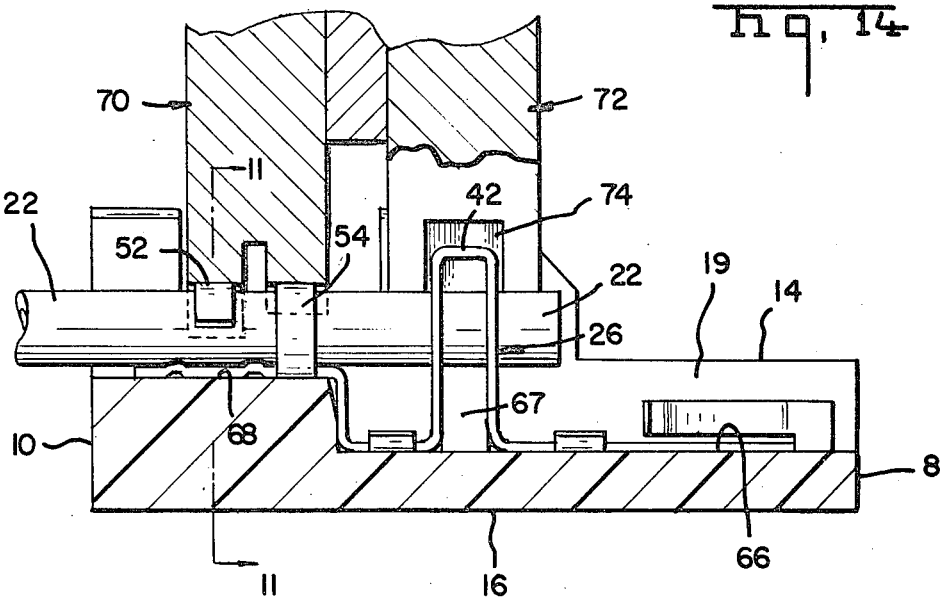
FIG. 14 is a view similar to FIG. 13, showing the positions of the parts at the conclusion of the crimping process.

The floors or inner ends of the cavities have first portions 66 which extend inwardly from the mating face 8 and on which the contact portions and the connecting sections 34, 46 of the terminals are supported. The cavity floors each have second portions 68 which are proximate to the wire entry of the housing and which are offset, relative to the first portions 66, towards the side 14 of the housing, as best shown in FIG. 13. The second portions of the cavity floors thus support the web 50 of the crimpable portions 28 of the terminals.

The individual wires 22 are connected to the terminals by a crimping tool 70 and an insertion tool 72, these two tools being preferably mounted on a single insertion ram. The insertion tool comprises a plurality of side-by-side spaced-apart insertion punches 74 which are dimensioned such that they can enter the space between the straps 42 of the terminals and push the wires into the wire-receiving slots 44.

Figure 11:
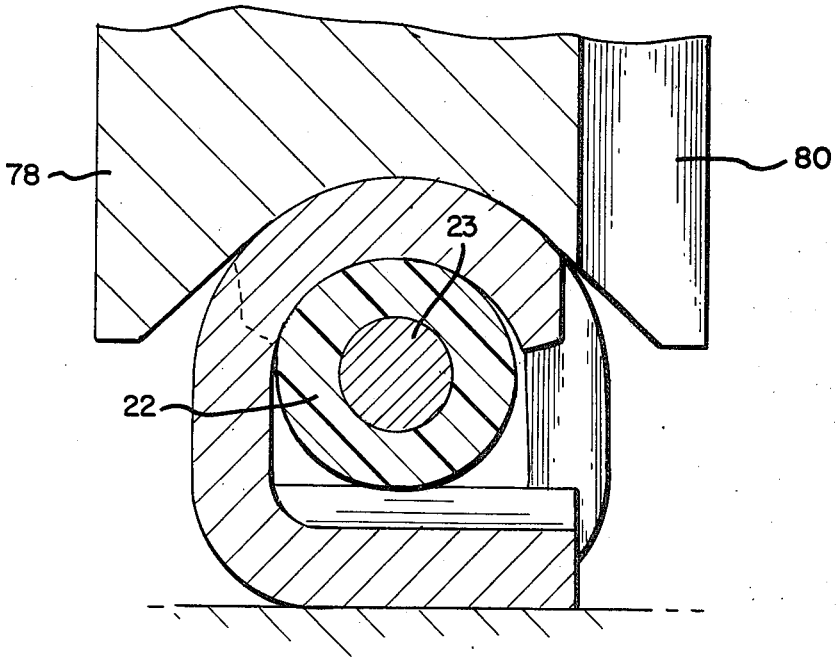
FIGS. 10 and 11 are views similar to FIG. 9, illustrating the successive stages of the crimping process, FIG. 11 being taken along the lines 11—11 of FIG. 14.
Figure 6:
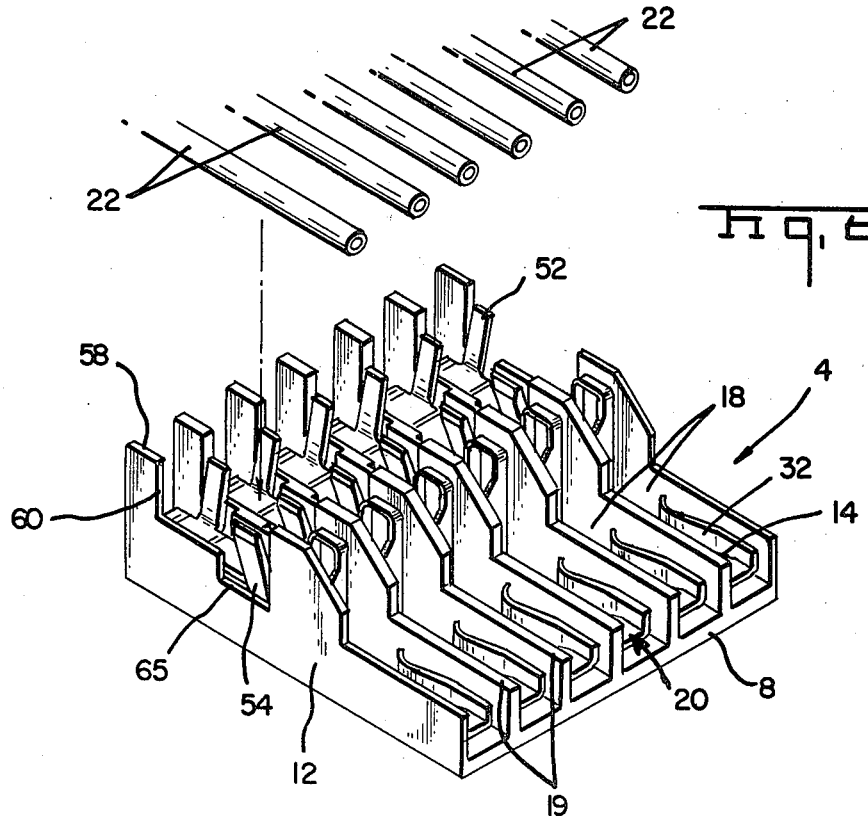
FIG. 6 is a perspective view similar to FIG. 1, but showing the terminals in their uncrimped condition and showing wires in alignment with the terminals in the connector housing.
Figure 9:
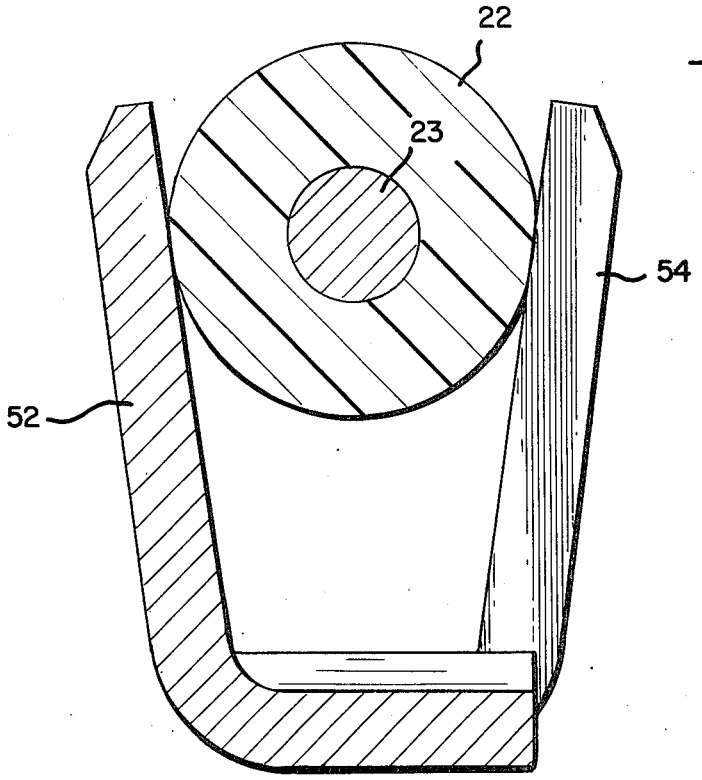
FIG. 9 is a sectional view on an enlarged scale taken along the lines 9—9 of FIG. 4 showing a wire in alignment with the crimpable portion of a terminal prior to crimping.
Figure 10:
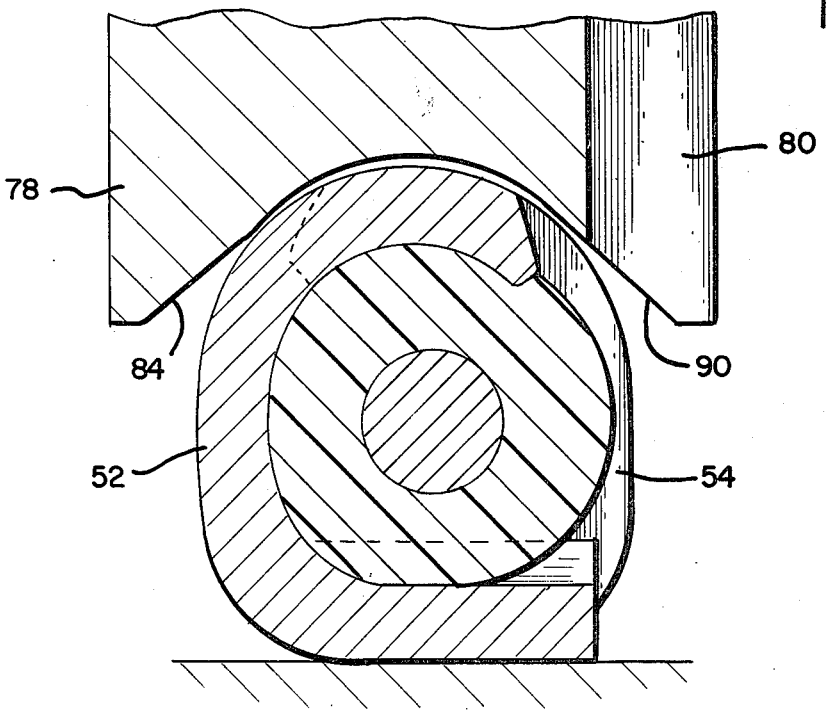
Figure 12:
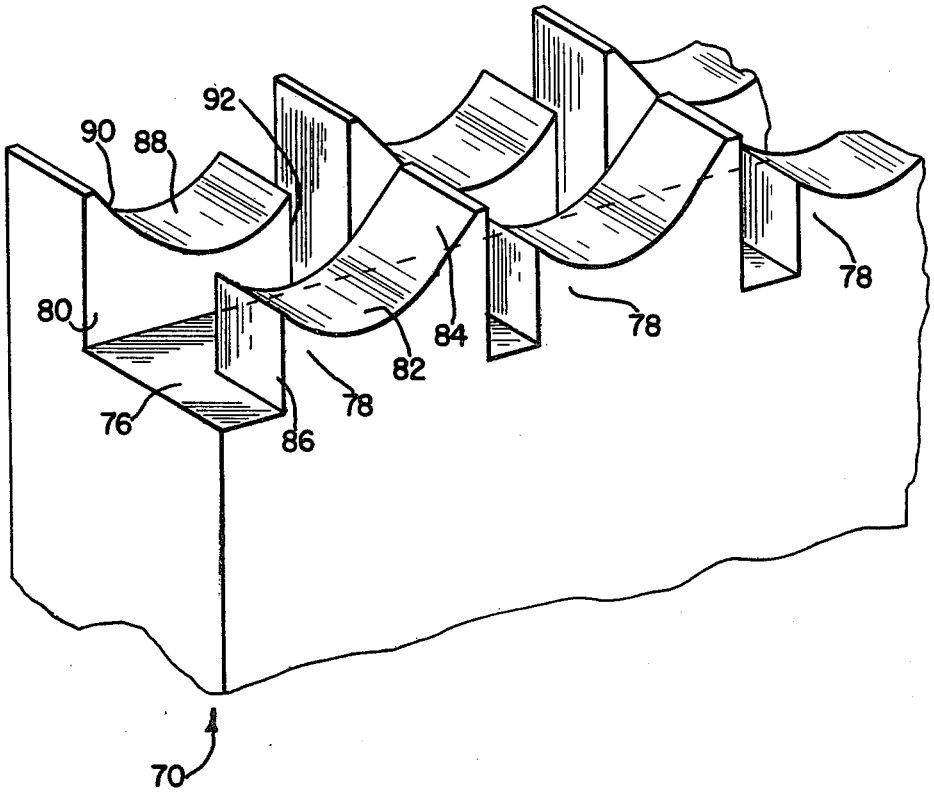
FIG. 12 is a fragmentary perspective view of the lower portion of the crimping tool, the tool being inverted in this view for purposes of clarity.

The lower end 76 of the crimping tool 70 (shown in an inverted position in FIG. 12) has a plurality of first crimping dies 78 arranged in a first row which extends across the lower end 76 and a second row of crimping dies 80. Each of the first crimping dies 78 has an arcuate surface 82 which engages the arm 52 of a terminal and an extension 84 on one side of surface 82 for effecting final crimping of the arm onto a wire as illustrated in FIGS. 9–11. Each first crimping die 78 is cut away as shown at 86 on the side opposite to the side of the extension 84 to enable the dies to move downwardly and into the individual cavities when the crimping tool is lowered to the position of FIG. 11. The second crimping dies 80 have an arcuate surface 88, an extension 90, and the second dies are relieved, or cut away, on one side as shown at 92, again to permit the dies to enter the cavities and crimp the arms 48 of the terminals.

Figure 8:
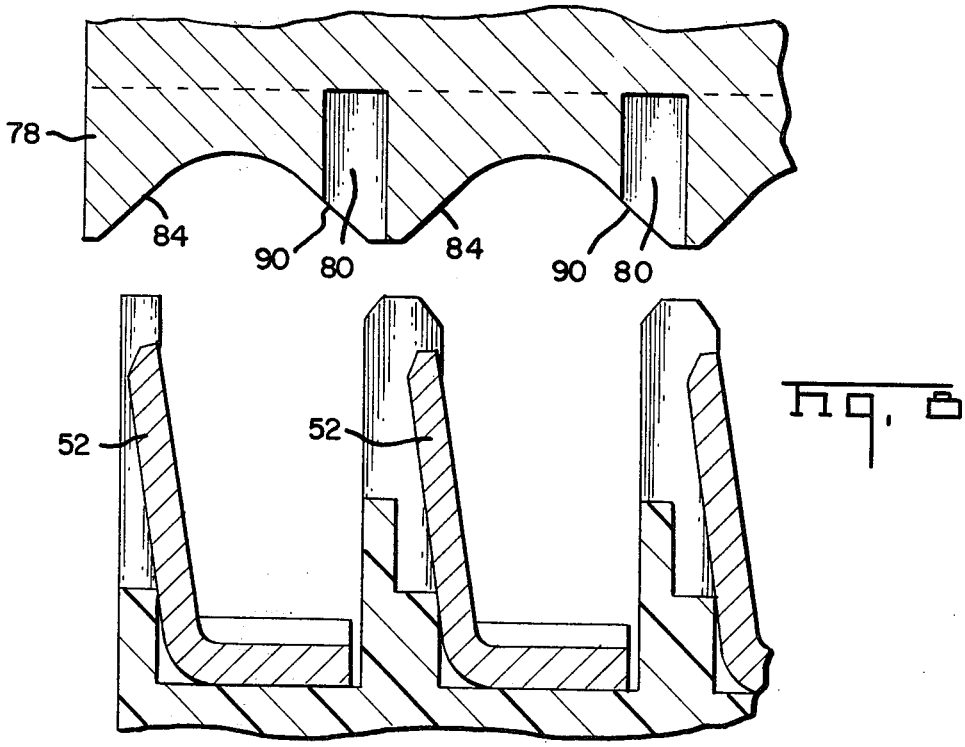
FIG. 8 is a view taken along the lines 8—8 of FIG. 7 and showing, in addition, the lower portion of a crimping tool for crimping the crimpable portions of the terminals onto wires.

The method of connecting the wires 22 to the terminals 20 will be apparent from FIGS. 9–11, 13, and 14. The wires are first aligned with the terminals in the connector housing and the crimping and insertion tooling 70, 72 is moved downwardly to cause the insertion punches 74 to insert the wires into the slots 44 and simultaneously crimp the arms 52, 54 onto the wires. The obliquely extending arms 52, 54 are engaged by the extensions 84, 90 of the crimping dies and the arms are curled inwardly as shown in FIG. 10. The arcuate surfaces 82, 88 then crimp the arms downwardly to the position of FIG. 11 so that the wire is tenaciously gripped or clamped against the corrugations 56 of the terminal. The importance of the cutaway sides 86, 92 of the dies and the provision of the notches 60 in the housing in permitting the crimping dies to move into the cavities will be apparent from FIGS. 8 and 11.

The wires 22 are preferably connected to the terminals by means of a cable making machine, such as those disclosed in U.S. Pat. No. 4,136,440, or by means of harness board tooling of the general type shown in U.S. Pat. No. 3,859,724 which is used to manufacture electrical harnesses. Many other types of insertion tooling might be used, but in any event, it is highly desirable to insert the wires into the slots 44 and crimp the terminals onto the wires in one stroke of the insertion and crimping tool. This method of manufacturing harnesses or cables produces an improved connection between the wires and the terminals with no added cost of expenditure of time.

As shown in FIG. 1, a shroud 6 can be assembled to the housing after the wires have been connected to the terminals. This shroud comprises a hollow plastic member which is closed at its leading end 94 and it has endwalls 96 and sidewalls 98, as shown. It is open at its rearward end so the housing can be inserted into the shroud, as indicated in the drawing. Suitable means can be provided to secure the shroud to the housing, such as internal latch means or the like.

The terminals 20, are loaded into the cavities 18 of the housing 4 by aligning a terminal with each cavity and moving the terminal laterally of its axis towards the first side 14 of the housing and into the cavity. The width of the cavities is such that the flanges or tangs 36, 47 bear against the cavity sidewalls and retain the terminals in the cavities. The disclosed embodiment of the present invention thus incorporates the teachings of Application Ser. No. 062,207 insofar as arrangement of the terminals in the cavities is concerned. As mentioned previously, the strap portions 42 of the conductor receiving portions 26 of the terminals are supported during insertion of the wires by the shoulders 69 on the upper ends of the bosses 67. The wires emerge from the rearward end 10, or wire entry end 10, of the housing in the conventional manner.

It will be apparent that the practice of the invention provides a conventional type crimped strain relief in combination with a wire-in-slot type termination in a manner such that tensile forces applied to the wire are transmitted to the terminal by the crimped strain relief portions and these tensile forces entirely bypass the electrical connections to the terminals. Moreover, the crimped strain reliefs can be inspected after the wires have been connected to the terminals and any damaged or improperly crimped terminals removed at the time the connector is installed on the ends of the wires.

We claim:

1. A preloaded multi-contact electrical connector of the type comprising an insulating housing having a mating face, a wire entry face, oppositely directed endwalls, and oppositely directed sides extending between said faces, a plurality of side-by-side cavities extending through said housing and between said faces, each of said cavities having opposed cavity sidewalls which extend normally of said sides of said housing and having a floor, each of said cavities having a wire-admitting portion which opens onto one of said sides and which extends from said wire entry face at least partially towards said mating face, an electrical contact terminal in each of said cavities, each of said terminals having a contact portion which is proximate to said mating face and a wire-rereceiving portion which is intermediate said faces and adjacent to said wire-admitting portion of its respective cavity, said wire-receiving portion having a free end which is adjacent to said one side of said housing and having wire-receiving slot means extending inwardly from said free end, said slot means having inner end portions dimensioned to penetrate the insulation of said wire and establish electrical contact with the conducting core thereof upon movement of said wire laterally of its axis and into said slot means, said connector being characterized in that:

each of said terminals, has a crimpable strain relief portion integral therewith proximate to said wire entry face, said strain relief portion having a web and terminal sidewall means extending from said web towards said one side of said housing, said terminal sidewall means having tool engageable free end portions which are spaced from said cavity sidewalls of the cavity in which said terminal is disposed thereby to permit engagement with a crimping tool and bending of said terminal sidewall means towards said web, said cavity sidewalls having notches therein, said free end portions of said terminal sidewall means being received in said notches whereby, upon placement of a plurality of wires in side-by-side relationship and in alignment with said terminals, and upon movement of said wires of their axes and into said wire-receiving portions of said terminals, said wires will be located on said webs, and upon bending of said sidewall means towards said webs and against said wires, said crimpable portions will be crimped onto said wires and said wires will extend from said wire entry face of said housing.

2. An electrical connector as set forth in claim 1, said terminal sidewall means of said strain relief portion of each of said terminals comprising first and second sidewall arms, said first sidewall arm being proximate to said wire entry face of said housing and extending from one side edge of said web, said second sidewall arm being inwardly spaced from said wire entry face and extending from the other side edge of said web.

3. An electrical connector as set forth in either of claims 1 or 2, said strain relief portion of each of said terminals being offset, relative to said inner end portion of said slot means, towards said one side of said housing, said cavity floor of each cavity having a first portion which supports said contact portion and said wire-receiving portion of the terminal in each cavity, and having a second portion which supports said crimpable portion, said second portion of said floor being offset towards said one side of said housing relative to said first portion.

4. An electrical connector as set forth in claim 2, said wire-receiving portion of each of said terminals comprising a pair of spaced-apart plate-like members extending normally of said floor and normally of said cavity sidewalls of the cavity in which each terminal is disposed, said free end comprising spaced-apart connecting straps extending between said plate-like members, said wire-receiving slot means comprising aligned slots in said plate-like members.

5. An electrical connector as set forth in claim 4, said contact portion of each of said terminals comprising a contact receptacle which is dimensioned to receive a complementary contact pin.

6. An electrical connector as set forth in claim 1, said terminal sidewall means of said strain relief portion of each of said terminals comprising first and second sidewall arms, said first sidewall arm being proximate to said wire entry face of said housing and extending from one side edge of said web, said second sidewall arm being inwardly spaced from said wire entry face and extending from the other side edge of said web, said cavity sidewalls having notches therein spaced from said wire entry end of said housing, said arms extending into said notches.

7. An electrical connector as set forth in claim 6, said strain relief portion of each of said terminals being offset relative to said inner portion of said slot means, towards said one side of said housing, said cavity floor of each cavity having a first portion which supports said contact portion and said wire-receiving portion of the terminal in each cavity, and having a second portion which supports said crimpable portion, said second portion of said floor being offset towards said one side of said housing relative to said first portion.

* * * * *